US008133331B2

(12) United States Patent
Langan

(10) Patent No.: US 8,133,331 B2
(45) Date of Patent: Mar. 13, 2012

(54) ALUMINUM-ZINC-MAGNESIUM-SCANDIUM ALLOYS AND METHODS OF FABRICATING SAME

(75) Inventor: Timothy Langan, Catonsville, MD (US)

(73) Assignee: Surface Treatment Technologies, Inc., Halethorpe, MD (US)

( * ) Notice: Subject to any disclaimer, the term of this patent is extended or adjusted under 35 U.S.C. 154(b) by 1388 days.

(21) Appl. No.: 11/345,169

(22) Filed: Feb. 1, 2006

(65) Prior Publication Data

US 2010/0068090 A1 Mar. 18, 2010

Related U.S. Application Data

(60) Provisional application No. 60/648,775, filed on Feb. 1, 2005.

(51) Int. Cl.
*C22C 21/10* (2006.01)

(52) U.S. Cl. ..... 148/415; 420/541

(58) Field of Classification Search ..... 148/415, 148/437; 420/541

See application file for complete search history.

(56) References Cited

U.S. PATENT DOCUMENTS

| | | | |
|---|---|---|---|
| 1,920,090 | A | 7/1933 | Lyon |
| 3,306,787 | A | 2/1967 | Dies |
| 3,619,181 | A | 11/1971 | Willey |
| 3,856,584 | A | 12/1974 | Cina |
| 4,689,090 | A | 8/1987 | Sawtell et al. |
| 4,832,758 | A | 5/1989 | Brown |
| 4,869,870 | A | 9/1989 | Rioja et al. |
| 5,032,359 | A | 7/1991 | Pickens et al. |
| 5,061,327 | A | 10/1991 | Denzer et al. |
| 5,122,339 | A | 6/1992 | Pickens et al. |
| 5,198,045 | A | 3/1993 | Cho et al. |
| 5,211,910 | A | 5/1993 | Pickens et al. |
| 5,221,377 | A | 6/1993 | Hunt, Jr. et al. |
| 5,462,712 | A | 10/1995 | Langan et al. |
| 5,507,888 | A | 4/1996 | Dickson, Jr. et al. |
| 5,512,241 | A | 4/1996 | Kramer et al. |
| 5,597,529 | A | 1/1997 | Tack |
| 5,620,652 | A | 4/1997 | Tack et al. |

(Continued)

FOREIGN PATENT DOCUMENTS

| | | | |
|---|---|---|---|
| EP | 0368005 | A1 | 5/1900 |

(Continued)

OTHER PUBLICATIONS

"Aluminum and Aluminum Alloys", ASM International, 1993, p. 45.*

(Continued)

*Primary Examiner* — Roy King
*Assistant Examiner* — Janelle Morillo
(74) *Attorney, Agent, or Firm* — Alan G. Towner, Esq.; Pietragallo Gordon Alfano Bosick & Raspanti, LLP

(57) ABSTRACT

Aluminum-zinc-magnesium-scandium alloys containing controlled amounts of alloying additions such as silver and tin are disclosed. The presence of Ag and/or Sn alloying additions improves fabrication characteristics of the alloys, such as the ability to be extruded at high temperatures and very high extrusion rates. The Al—Zn—Mg—Sc alloys may optionally include other alloying additions such as Cu, Mn, Zr, Ti and the like. The alloys possess good properties such as relatively high strength and excellent corrosion resistance. The alloys may be fabricated into various product forms such as extrusions, forgings, plate, sheet and weldments.

12 Claims, 3 Drawing Sheets

U.S. PATENT DOCUMENTS

| | | | | |
|---|---|---|---|---|
| 5,865,911 | A | 2/1999 | Miyasato et al. | |
| 6,027,582 | A | 2/2000 | Shahani et al. | |
| 6,524,410 | B1 * | 2/2003 | Kramer et al. | 148/550 |
| 6,627,012 | B1 | 9/2003 | Tack et al. | |
| 7,048,815 | B2 | 5/2006 | Senkov et al. | |
| 2002/0162609 | A1 | 11/2002 | Warner | |
| 2003/0219353 | A1 | 11/2003 | Warner et al. | |
| 2004/0089378 | A1 | 5/2004 | Senkov et al. | |
| 2004/0089382 | A1 | 5/2004 | Senkov et al. | |
| 2005/0056353 | A1 | 3/2005 | Brooks et al. | |
| 2005/0269000 | A1 * | 12/2005 | Denzer et al. | 148/701 |

FOREIGN PATENT DOCUMENTS

| | | | | |
|---|---|---|---|---|
| EP | 1413636 | A1 | | 4/2004 |
| JP | 9279284 | A | | 10/1997 |
| JP | 09279284 | A | * | 10/1997 |
| JP | 2000317676 | A | | 11/2000 |
| RU | 2233902 | C1 | | 8/2004 |
| RU | 2243278 | C1 | | 12/2004 |
| SU | 1657538 | A | | 6/1991 |
| SU | 1417487 | A | | 7/1993 |
| WO | WO 94/24326 | | | 10/1994 |
| WO | WO 95/26420 | | | 10/1995 |
| WO | WO00/54967 | | | 9/2000 |
| WO | WO03/085146 | A1 | | 10/2003 |
| WO | WO2004/046402 | A2 | | 6/2004 |

OTHER PUBLICATIONS

L.S. Toropova et al., "Advanced Aluminum Alloys Containing Scandium—Structure and Properties", p. 157, 1998, Gordon and Breach Science Publishers.

Ralph R. Sawtell et al. "Exploratory Alloy Development in the System Al-Sc-X", Dispersion Strengthened Aluminum Alloys, pp. 409-420, 1988, The Minerals, Metals & Materials Society.

V.I. Elagin et al., "Non-Ferrous Metals and Compounds", pp. 1-12, Nov. 17, 1993, UDK 669.715793.

Ralph R. Sawtell et al., "Mechanical Properties and Microstructures of Al-Mg-Sc Alloys", Metallurgical Transactions A, vol. 21A, Feb. 1990, pp. 421-430.

Motohiro Kanno et al., "The Effect of Recrystallization on Precipitation in Some Age-Hardenable Aluminum Alloys", pp. 547-552, 1990, The Minerals, Metals & Materials Society.

B.A. Parker et al., "The Effect of Small Additions of Scandium on the Properties of Aluminum Alloys", pp. 452-458, 1995, Chapman & Hall.

J. Glonnes et al., "An Electron Microscope Investigation of the Microstructure in an Aluminum-Zinc-Magnesium Alloy", ACTA Metallurgica, vol. 18, Aug. 1970, pp. 881-890.

Motohiro Kanno et al., "Precipitation Phenomena Affected by Dispersoid in 7XXX Alloys", Light Materials for Transportation Systems, Center for Advanced Aerospace Materials, 1993, pp. 377-389.

T. Sato et al., "Modulated Structures and GP Zones in Al-Mg Alloys", Metallurgical Transactions A, vol. 13A, Aug. 1982, pp. 1373-1378.

David A. Lukasak et al., "Strong Aluminum Alloy Shaves Airframe Weight", Advanced Materials & Processes, Oct. 1991, pp. 46-49.

M.L. Kharakterova et al., "Precipitation Hardening in Ternary Alloys of the Al-Sc-Cu and Al-Sc-Si Systems", 0956-7151(94)E0026-D, ACTA Metallurgical Materials, vol. 42, No. 7, pp. 2285-2290, 1994.

L.I. Ivanov et al., "Radiation Resistance and Parameters of Activation of Aluminum-Magnesium-Scandium and Aluminum-Magnesium-Vandium Alloys Under Neutron Irradiation", Journal of Nuclear Materials, 191-194 (1992), pp. 1075-1079.

C. Tan et al., "The Ageing Behaviour and Tensile Properties of Al-Sc Alloy", Aluminum Alloys and Their Physical and Mechanical Properties, pp. 290-294, The Third International Conference on Aluminum, The Norwegian Institute of Technology, Dept. of Metallurgy and SINTEF Metallurgy, Trondheim, Norway, Jun. 1992.

X.J. Jiang et al., "Effects of Minor Additions on Precipitation and Properties of Al-Li-Cu-Mg-Zr Alloy", Scripta Metallurigica et Materialia, vol. 29, 1993, pp. 211-216.

Ministry of Science and Technical Policy of Russia (Abstracts of Reports) International Conference, "Scandium and Prospects of Its Use", Abstracts 1-56, pp. 1-14, Oct. 18-19, 1994, Moscow, Russia.

Shin-Ichiro Fujikawa et al., "Solid Solubility and Residual Resisitivity of Scandium in Aluminum". Journal of the Less Common Metals, 63 (1979) pp. 87-97.

A.L. Berezina et al., "The Efficiency of Low-Temperature Ageing of Al-Cu-Li-Zr System Alloys", pp. 289-294, Sixth International Aluminium-Lithium Conference; Garmisch-Partenkirchen, Germany; Oct. 7-11, 1991.

L.I. Kaygorodova et al., "The Effect of Small Sc and Mg Addition on Al-Li-Cu-Zr Alloy Structure and Mechanical Properties", pp. 363-367, Sixth International Aluminium-Lithium Conference; Garmisch-Partenkirchen, Germany; Oct. 7-11, 1991.

R.K. Bird et al., "Al-Li Alloy 1441 for Fuselage Applications", National Aeronautics and Space Administration (NASA) Langley Research Center,Hampton, Virginia, USA and All-Russia Institute of Aviation Materials (VIAM), Moscow, Russia, pp. 1-6, undated.

* cited by examiner

ALUMINUM-ZINC-MAGNESIUM-SCANDIUM ALLOYS AND METHODS OF FABRICATING SAME

CROSS-REFERENCE TO RELATED APPLICATION

This application claims the benefit of U.S. Provisional Patent Application Ser. No. 60/648,775 filed Feb. 1, 2005, which is incorporated herein by reference.

FIELD OF THE INVENTION

The present invention relates to 7XXX series aluminum-zinc-magnesium alloys containing scandium, and more particularly relates to Al—Zn—Mg—Sc alloys having controlled amounts of alloying additions such as Ag and Sn. The alloys possess favorable properties such as good corrosion resistance, high strength, and improved fabrication characteristics, including the ability to be extruded at relatively high temperatures and very high extrusion rates.

BACKGROUND INFORMATION

Various types of aluminum-scandium alloys have been proposed. For example, U.S. Pat. No. 4,689,090 to Sawtell et al. discloses Al—Mg—Sc alloys which are said to possess improved superplastic forming properties.

U.S. Pat. No. 6,524,410 to Kramer et al. discloses 7XXX Al—Zn—Mg—Mn—Sc alloys useful as extruded bicycle tubing. However, welded structures fabricated from these alloys can be susceptible to stress corrosion cracking, which is a problem associated with many 7XXX alloys.

U.S. Pat. Nos. 5,597,529 and 5,620,652 to Tack et al. disclose aluminum-scandium alloys such as 7XXX Al—Zn—Mg—Mn—Cu—Sc alloys useful as recreational, athletic, aerospace, ground transportation and marine structures. These Cu-containing alloys suffer from susceptibility to general corrosion and may exhibit poor weldability in some cases.

SUMMARY OF THE INVENTION

The present invention provides aluminum-zinc-magnesium-scandium alloys containing Ag and/or Sn alloying additions. The Al—Zn—Mg—Sc—Ag/Sn alloys can be provided in various product forms such as extrusions, forgings, plate, sheets and weldments. The alloys may be fabricated utilizing high deformation rates, such as high extrusion rates.

An aspect of the present invention is to provide a wrought aluminum alloy comprising from 0.5 to 10 weight percent Zn, from 0.1 to 10 weight percent Mg, from 0.01 to 2 weight percent Sc, at least 0.01 weight percent of at least one alloying addition selected from Ag and Sn, and the balance aluminum and incidental impurities, wherein the Ag alloying addition comprises up to 1 weight percent and the Sn alloying addition comprises up to 0.5 weight percent of the alloy.

Another aspect of the present invention is to provide a method of working an aluminum alloy. The method comprises providing an aluminum alloy comprising from 0.5 to 10 weight percent Zn, from 0.1 to 10 weight percent Mg, from 0.01 to 2 weight percent Sc, at least 0.01 weight percent of at least one alloying addition selected from Ag and Sn, and the balance aluminum and incidental impurities, wherein the Ag alloying addition comprises up to 1 weight percent and the Sn alloying addition comprises up to 0.5 weight percent of the alloy; and working the alloy to form a wrought product such as an extrusion, forging, rolled plate, rolled sheet or the like.

These and other aspects of the present invention will be more apparent from the following description.

DETAILED DESCRIPTION

Figure 1:
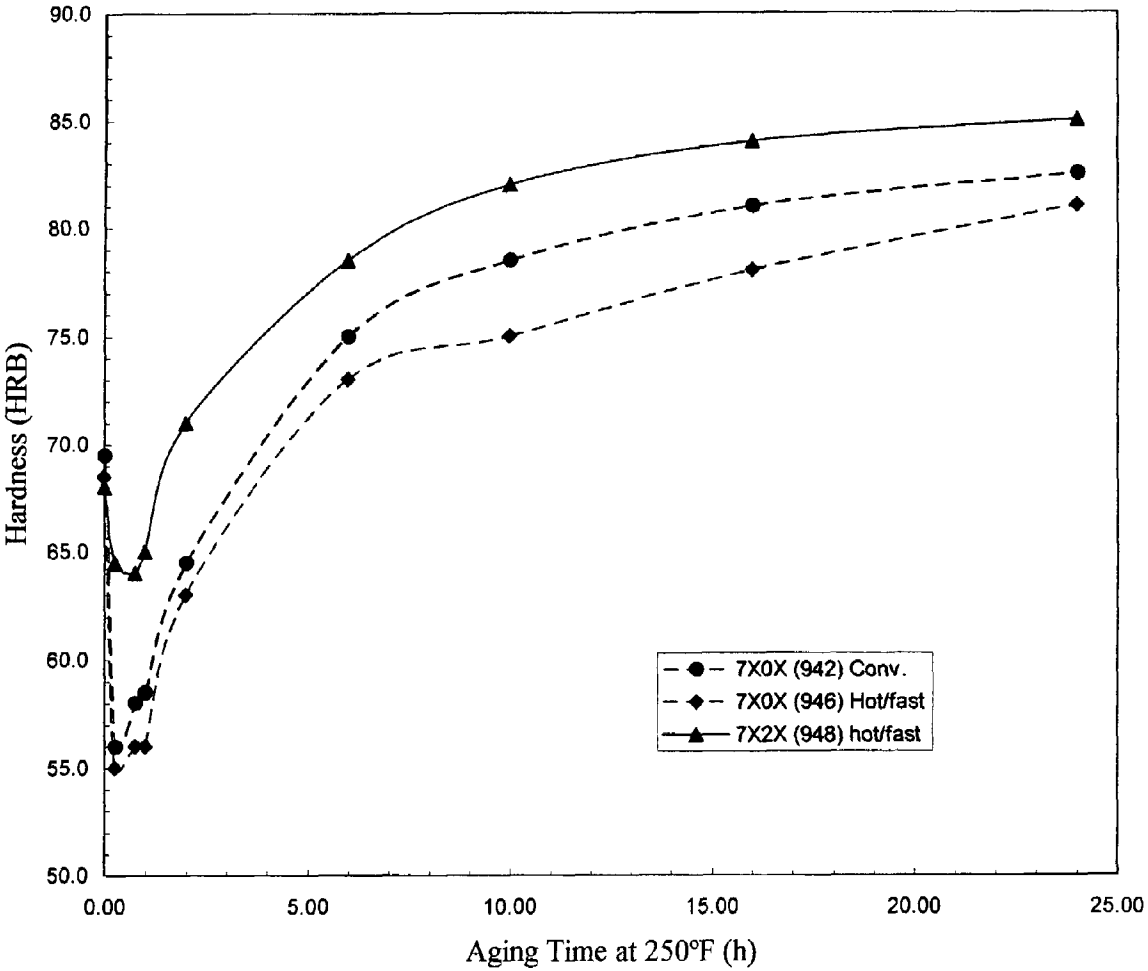
FIG. 1 is a plot of hardness versus aging time for Al—Zn—Mg—Mn—Sc alloy extrusions. One of the hardness plots corresponds to an Ag-containing alloy (7X2X) in accordance with an embodiment of the present invention which had been extruded at a relatively high temperature (825° F.) and a relatively high extrusion rate (15 feet/minute). The other hardness plots correspond to an Ag-free alloy (7X0X), one extrusion of which was subjected to a similar extrusion temperature and extrusion rate, and the other extrusion of which was subjected to a conventional extrusion temperature (725° F.) and extrusion rate (2 feet/minute) typically used for 7XXX alloys. The high extrusion rate Ag-containing alloy possesses significantly improved hardness in comparison with the other extrusions.

Table 1 lists typical, preferred and more preferred compositional ranges, and some particular alloy examples, in accordance with embodiments of the present invention.

TABLE 1

Compositional Ranges of Al—Zn—Mg—Sc Alloys (Wt. %)

| | Zn | Mg | Sc | Ag | Sn | Cu | Mn | Zr | Ti |
|---|---|---|---|---|---|---|---|---|---|
| Typical | 0.5-10 | 0.1-10 | 0.01-2 | 0-1 | 0-0.5 | 0-2 | 0-1 | 0-1 | 0-0.5 |
| Preferred | 2-9 | 0.5-5 | 0.02-1 | 0-0.5 | 0-0.3 | 0-1 | 0-0.5 | 0-0.5 | 0-0.1 |
| More Preferred | 4-7 | 1-3 | 0.05-0.2 | 0-0.3 | 0-0.2 | 0-0.5 | 0-0.3 | 0-0.2 | 0-0.05 |
| Example 1 | 5.25 | 2.2 | 0.12 | 0.05 | 0 | 0 | 0.2 | 0.14 | 0.01 |
| Example 2 | 5.25 | 2.2 | 0.12 | 0.1 | 0 | 0 | 0.2 | 0.14 | 0.03 |
| Example 3 | 5.25 | 2.2 | 0.12 | 0 | 0.05 | 0 | 0.2 | 0.14 | 0.01 |
| Example 4 | 5.25 | 2.2 | 0.12 | 0 | 0.1 | 0 | 0.2 | 0.14 | 0.03 |
| Example 5 | 5.25 | 2.2 | 0.12 | 0.05 | 0 | 0.2 | 0.2 | 0.14 | 0.03 |
| Example 6 | 5.25 | 2.2 | 0.12 | 0.1 | 0 | 0.2 | 0.2 | 0.14 | 0.03 |
| Example 7 | 5.25 | 2.2 | 0.12 | 0 | 0.05 | 0.2 | 0.2 | 0.14 | 0.03 |
| Example 8 | 5.25 | 2.2 | 0.12 | 0 | 0.1 | 0.2 | 0.2 | 0.14 | 0.03 |

In accordance with an embodiment of the present invention, Ag is added to Al—Zn—Mg—Sc alloys in controlled amounts. Silver additions enhance the formation of strengthening precipitates, particularly inside the grains. Silver facilitates the nucleation of more and finer precipitates which increases the strength of the alloy and reduces slip step problems relating to cracking. In addition, silver additions decrease susceptibility to stress corrosion cracking, making the alloys more suitable for use in applications such as marine structures, friction stir weldments, aircraft structures, ground vehicles, rail cars and passenger rolling stock.

In accordance with an embodiment of the present invention, Sn is added to Al—Zn—Mg—Sc alloys in controlled amounts. Tin additions enhance the formation of strengthening precipitates, particularly inside the grains. Tin facilitates the nucleation of more and finer precipitates which increases the strength of the alloy and reduces slip step problems relating to cracking. In addition, tin additions decrease susceptibility to stress corrosion cracking, making the alloys more suitable for use in applications such as marine structures, friction stir weldments, aircraft structures, ground vehicles, rail cars and passenger rolling stock.

Although the use of Ag and Sn alloying additions are primarily described herein, other alloy additions such as Cd may be used as partial or total substitutes for Ag and/or Sn.

In accordance with the present invention, Sc additions inhibit recrystallization, improve resistance to fatigue and decrease susceptibility to localized environmental attack (e.g., stress corrosion cracking and exfoliation corrosion) of the alloys. Scandium additions have been found to permit higher deformation rates, including the ability to extrude the alloys at higher temperatures and much higher extrusion rates than possible with conventional 7XXX alloys. Thus, in accordance with the present invention, the addition of Sc has been found to permit significantly increased deformation rates during fabrication of the alloys into various wrought product forms. For example, higher extrusion rates of at least 5, 10 or 12 feet/minute may be achieved. In addition, higher extrusion temperatures of greater than 750, 775, 800 or 825° F. may be achieved. This is in contrast with conventional 7XXX alloys which have traditionally been restricted to extrusion rates of less than 5 feet/minute, and extrusion temperatures of less than 750° F.

Magnesium improves the mechanical properties of the alloy by formation of strengthening precipitates and solid solution strengthening.

Copper may optionally be added to the alloys in accordance with an embodiment of the present invention. Copper in relatively minor amounts of from about 0.1 to about 0.5 weight percent may increase strength somewhat and reduce susceptibility to stress corrosion cracking. However, such copper additions may decrease weldability and increase susceptibility to general corrosion.

In one embodiment of the present invention, the Al—Zn—Mg—Sc alloys are substantially free of Cu, i.e., copper is not purposefully added as an alloying addition to the alloy but may be present in very minor or trace amounts as an impurity. Furthermore, the alloys may be substantially free of other elements such as Mn and Cr, as well as any other element that is not purposefully added to the alloy.

Manganese may optionally be added to the present alloys in order to nucleate grains during solidification and inhibit grain growth and recrystallization.

Zirconium may optionally be added to the present alloys in order to inhibit grain growth and recrystallization.

Titanium may optionally be added to the present alloys in order to nucleate grains during solidification and inhibit grain growth and recrystallization.

In addition to the above-noted alloying additions, other alloying elements such as Hf, Cr, V, B and rare earth elements such as Ce may optionally be added to the present alloys in total amounts of up to 0.5 weight percent.

The following examples are intended to illustrate various aspects of the present invention, and are not intended to limit the scope of the invention. Billets of each of the alloys listed below in Table 2 were made by weighing out and loading Al (99.99%) and Al—Zn, Al—Mg, Al—Zr, Al—Cu, Al—Mn and Al—Sc master alloys into an induction-casting furnace for each composition listed in Table 2. The charges were melted and poured into cast iron molds. After casting the hot tops were removed and the billets were homogenized. After homogenization the billets were extruded.

TABLE 2

Nominal Composition of Al—Zn—Mg—Sc Billets (Wt. %)

| Billet # | Zn | Mg | Cu | Ti | Zr | Mn | Sc | Ag | Sn | Al |
|---|---|---|---|---|---|---|---|---|---|---|
| 1 | 5.25 | 2.2 | — | 0.03 | 0.14 | 0.20 | 0.12 | — | — | bal |
| 2 | 5.25 | 2.2 | — | 0.03 | 0.14 | 0.20 | 0.12 | — | — | bal |
| 3 | 5.25 | 2.2 | — | 0.03 | 0.14 | 0.20 | 0.12 | — | — | bal |
| 4 | 5.25 | 2.2 | — | 0.03 | 0.14 | 0.20 | 0.12 | — | — | bal |
| 5 | 5.25 | 2.2 | — | 0.03 | 0.14 | 0.20 | 0.12 | — | — | bal |
| 6 | 5.25 | 2.2 | — | 0.03 | 0.14 | 0.20 | 0.12 | — | — | bal |
| 7 | 5.25 | 2.2 | — | 0.01 | 0.14 | 0.20 | 0.12 | — | — | bal |
| 8 | 5.25 | 2.2 | — | 0.01 | 0.14 | 0.20 | 0.12 | — | — | bal |
| 9 | 5.25 | 2.2 | 0.20 | 0.03 | 0.14 | 0.20 | 0.12 | — | — | bal |
| 10 | 5.25 | 2.2 | — | 0.03 | 0.14 | 0.20 | 0.12 | 0.10 | — | bal |
| 11 | 5.25 | 2.2 | — | 0.01 | 0.14 | 0.20 | 0.12 | 0.05 | — | bal |
| 12 | 5.25 | 2.2 | — | 0.03 | 0.14 | 0.20 | 0.12 | — | 0.10 | bal |
| 13 | 5.25 | 2.2 | — | 0.01 | 0.14 | 0.20 | 0.12 | — | 0.05 | bal |

Some of the billets listed in Table 2 were extruded using the parameters shown in Table 3, then solutionized, water quenched, stretch straightened, and aged for 24 hours at 250° F.

TABLE 3

Extrusion Parameters for Al—Zn—Mg—Sc Billets

| Billet # | Alloy | Preheat Temperature (° F.) | Breakout Pressure (psi) | Running Pressure (psi) | Runout Speed (feet/minute) | Size (inches) | Comments |
|---|---|---|---|---|---|---|---|
| 10 | 7X2X (Ag) | 825 | | | 12-15 | 4 × 0.25 | Hot preheat and Fast |
| 5 | 7X0X | 825 | 3500 | 2900 | 15 | 4 × 0.25 | Hot preheat and Fast |
| 12 | 7X3X (Sn) | 725 | 3000 | 2850 | 4 | 4 × 0.25 | Warm and slightly faster than "normal" |

TABLE 3-continued

Extrusion Parameters for Al—Zn—Mg—Sc Billets

| Billet # | Alloy | Preheat Temperature (° F.) | Breakout Pressure (psi) | Running Pressure (psi) | Runout Speed (feet/minute) | Size (inches) | Comments |
|---|---|---|---|---|---|---|---|
| 9 | 7X1X (Cu) | 725 | 3300 | 3000 | 6.7 | 4 × 0.25 | Warm and increase speed |
| 1 | 7X0X | 725 | 3300 | 2600 | 2-4 | 4 × 0.25 | Warm preheat. Started at 4 then slowed to 2 |
| 6 | 7X0X | 725 | 3500 | 3000 | 15 | 4 × 0.25 | Warm preheat and Fast |
| 2 | 7X0X | 725 | 2900 | 2700 | 1.5 | 4 × 0.25 | Surface blistering |
| 3 | 7X0X | 725 | 3000 | 2800 | 1.5 | 4 × 0.25 | |
| 4 | 7X0X | 725 | 3200 | 2900 | 3 | 4 × 0.25 | Run faster |

Figure 2:
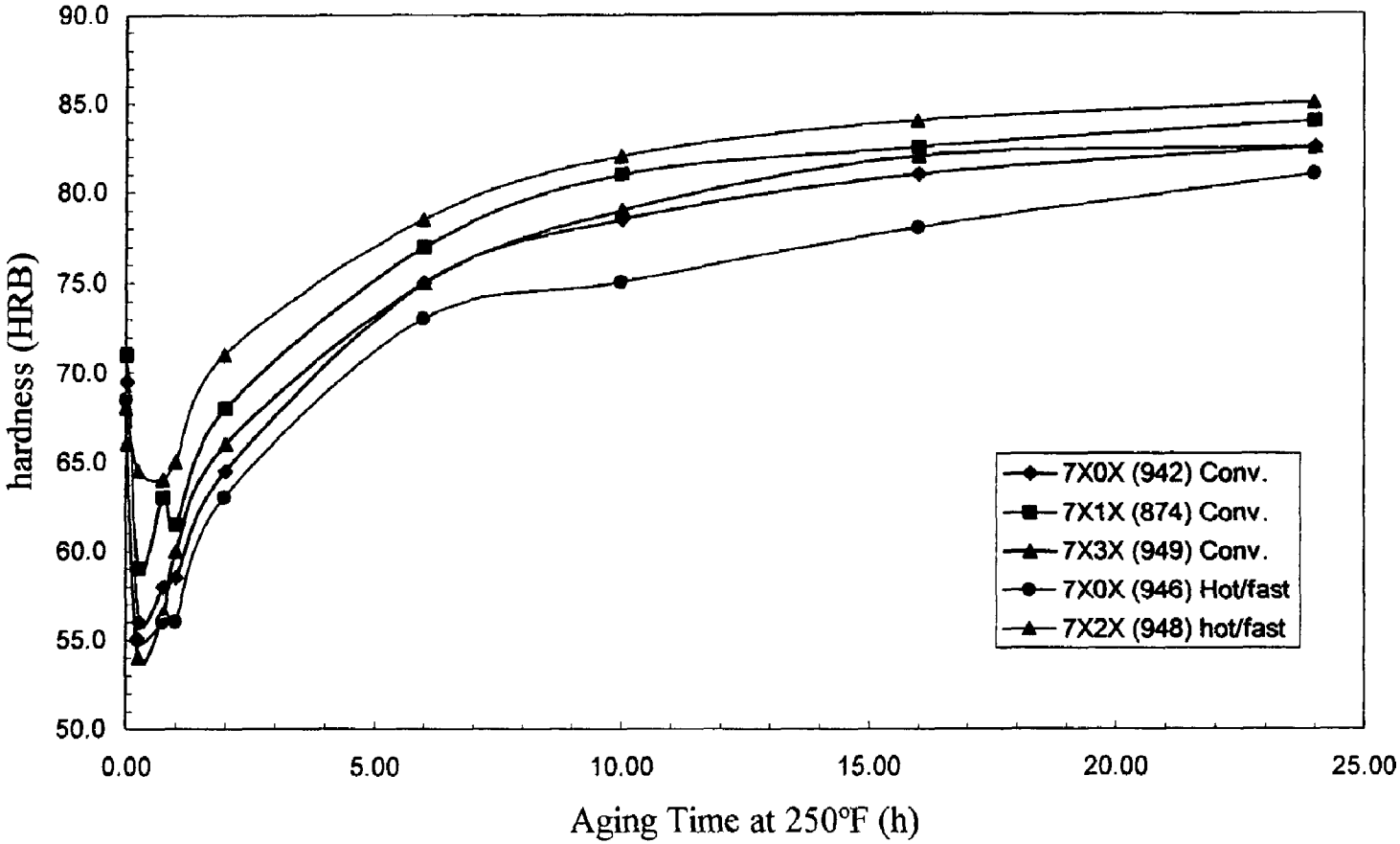
FIG. 2 is a plot of hardness versus aging time for Al—Zn—Mg—Sc alloy extrusions. The plot of FIG. 2 includes the same data as shown in FIG. 1, plus hardness plots for a Cu-containing alloy (7X1X) and a Sn-containing alloy (7X3X), both of which were extruded at a conventional extrusion temperature (725° F.) and extrusion rate (2 feet/minute) typically used for 7XXX alloys.
Figure 3:
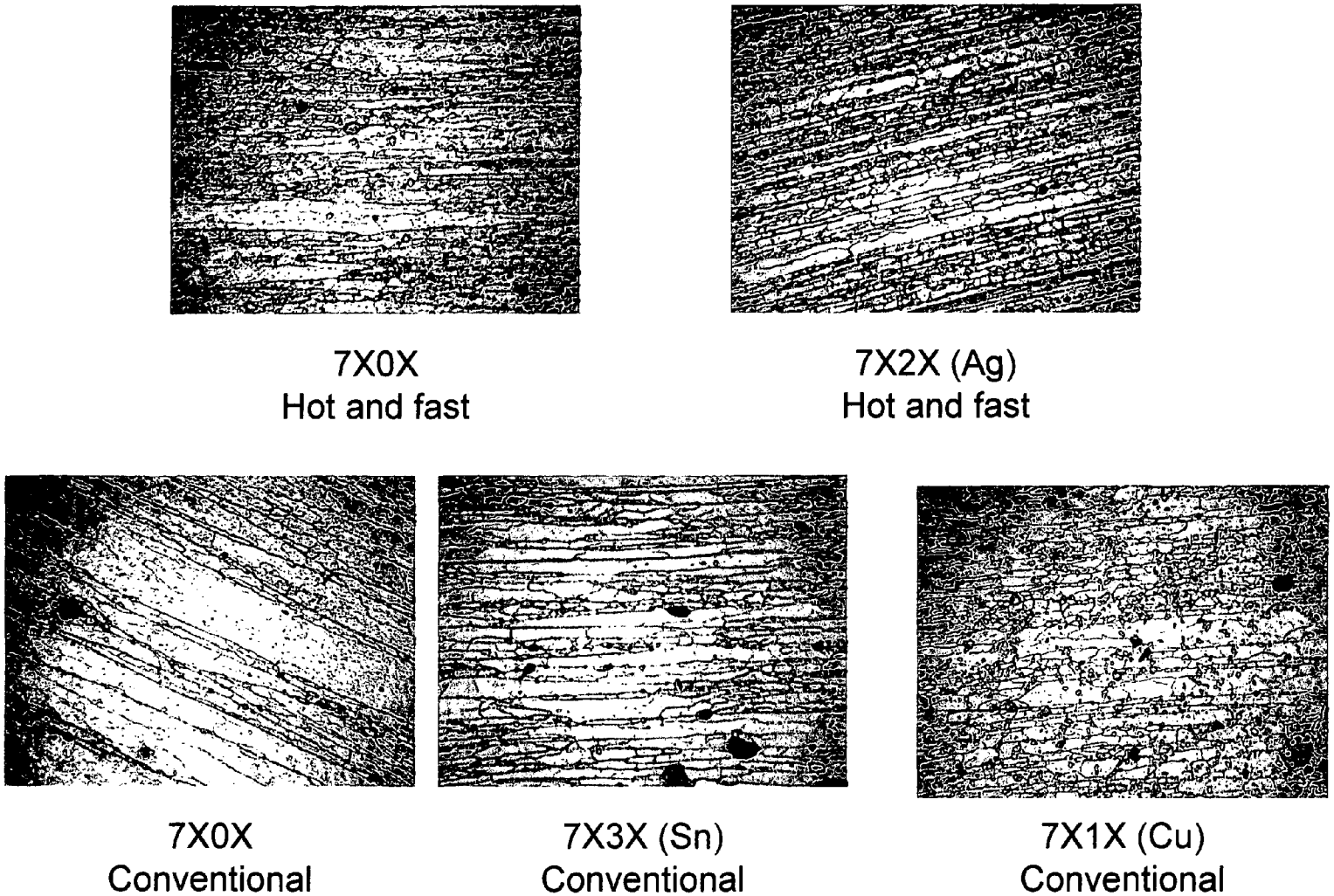
FIG. 3 shows photomicrographs illustrating the microstructure of each of the extrusions of FIG. 2.

FIGS. 1 and 2 are hardness plots versus aging time at 250° F. for several of the extrusions listed in Table 3. FIG. 3 shows photomicrographs for each of the extrusions of FIG. 2. These micrographs show a cross section of the pancaked grain structure that results for the extrusion process. It is clear from these micrographs that the grain size is finer in the Ag containing alloy that was extruded hot and fast.

Table 4 lists strength and elongation properties in the longitudinal direction (L) for Billet #'s 10 and 12 in a T6-type temper and a T7-type temper.

TABLE 4

Strength and Elongation Properties

| Billet # | Temper | YS (ksi) | UTS (ksi) | Elongation (%) |
|---|---|---|---|---|
| 10 | T6 | 79.5 | 83.3 | 17.1 |
| | T7 | 69.7 | 73.8 | 17.6 |
| 12 | T6 | 79.0 | 82.3 | 17.2 |
| | T7 | 69.3 | 73.7 | 18.0 |

In accordance with an embodiment of the present invention, a retrogression and re-age (RRA) heat treatment may be performed. For example, an extruded Al—Zn—Mg—Sc—Zr—Ag alloy may be aged using a modified heat treatment schedule designed to control the distribution of second phase precipitates on the grain boundaries and in the grain interiors, thereby optimizing strength, ductility, resistance to stress corrosion cracking and toughness. This treatment utilizes a high temperature exposure to revert the fine strengthening phase precipitates and coarsen phases on the grain boundaries, followed by reaging to a peak aged temper.

Whereas particular embodiments of this invention have been described above for purposes of illustration, it will be evident to those skilled in the art that numerous variations of the details of the present invention may be made without departing from the invention.

The invention claimed is:

1. A wrought aluminum alloy comprising from 0.5 to 10 weight percent Zn, from 0.1 to 10 weight percent Mg, from 0.01 to 2 weight percent Sc, at least 0.01 weight percent of at least one alloying addition selected from Ag and Sn, and the balance aluminum and incidental impurities, wherein the Ag alloying addition comprises up to 1 weight percent and the Sn alloying addition comprises up to 0.5 weight percent of the alloy, the alloy is substantially free of Cu, Mn, Cr, V, Ni and Mo, and the alloy is in a T7 temper with an unrecrystallized grain structure.

2. The wrought aluminum alloy of claim 1, wherein the Zn comprises from 2 to 9 weight percent, the Mg comprises from 0.5 to 5 weight percent, and the Sc comprises from 0.02 to 1 weight percent of the alloy.

3. The wrought aluminum alloy of claim 1, wherein the Zn comprises from 4 to 7 weight percent, the Mg comprises from 1 to 3 weight percent, and the Sc comprises from 0.05 to 0.2 weight percent of the alloy.

4. The wrought aluminum alloy of claim 1, wherein the alloying addition is Ag and is present in an amount of from 0.01 to 1 weight percent of the alloy.

5. The wrought aluminum alloy of claim 1, wherein the alloying addition is Ag and is present in an amount of from 0.02 to 0.5 weight percent of the alloy.

6. The wrought aluminum alloy of claim 1, wherein the alloying addition is Ag and is present in an amount of from 0.03 to 0.3 weight percent of the alloy.

7. The wrought aluminum alloy of claim 1, wherein the alloying addition is Sn and is present in an amount of from 0.01 to 0.5 weight percent of the alloy.

8. The wrought aluminum alloy of claim 1, wherein the alloying addition is Sn and is present in an amount of from 0.02 to 0.3 weight percent of the alloy.

9. The wrought aluminum alloy of claim 1, wherein the alloying addition is Sn and is present in an amount of from 0.03 to 0.2 weight percent of the alloy.

10. The wrought aluminum alloy of claim 1, further comprising up to 1 weight percent Zr and up to 0.5 weight percent Ti.

11. The wrought aluminum alloy of claim 1, further comprising from 0.01 to 0.5 weight percent Zr and from 0.01 to 0.1 weight percent Ti.

12. The wrought aluminum alloy of claim 1, wherein the alloy is in the form of an extrusion.

* * * * *